United States Patent [19]

Baugh

[11] Patent Number: 4,913,469

[45] **Date of Patent: * Apr. 3, 1990**

[54] WELLHEAD SLIP AND SEAL ASSEMBLY

[75] Inventor: Benton F. Baugh, Houston, Tex.

[73] Assignee: Cameron Iron Works USA, Inc., Houston, Tex.

[ * ] Notice: The portion of the term of this patent subsequent to Dec. 13, 2005 has been disclaimed.

[21] Appl. No.: 229,321

[22] Filed: Aug. 8, 1988

[51] Int. Cl.[4] ..... F21B 19/10; F16L 21/00

[52] U.S. Cl. ..... 285/146; 166/208

[58] Field of Search ..... 285/144, 145, 146, 147, 285/148, 918, 38, 23; 166/82, 86, 88; 277/9.5, 167.3, 197

[56] References Cited

U.S. PATENT DOCUMENTS

| | | | |
|---|---|---|---|
| 2,134,311 | 10/1938 | Minor | 285/144 X |
| 2,467,822 | 4/1949 | Griffin | 285/147 X |
| 2,531,596 | 11/1950 | Allen | 285/148 X |
| 2,824,757 | 2/1958 | Rhodes | 285/146 |
| 2,920,909 | 1/1960 | Allen | 285/146 |
| 3,051,513 | 8/1962 | Watts | 285/147 X |
| 3,094,337 | 6/1963 | Pippert | 285/918 X |
| 3,096,554 | 7/1963 | Johnson | 285/147 X |
| 3,127,198 | 3/1964 | Orund | 285/146 |
| 3,287,035 | 11/1966 | Greenwood | 285/147 |
| 3,299,958 | 1/1967 | Todd | 285/144 X |
| 3,311,168 | 3/1967 | Pierce, Jr. | 166/89 |
| 3,529,836 | 9/1970 | Hyde | 277/9.5 |
| 4,390,186 | 6/1983 | McGee et al. | 277/236 |
| 4,494,778 | 1/1985 | Johnson | 285/146 |
| 4,790,379 | 12/1988 | Vanderford | 285/146 X |

FOREIGN PATENT DOCUMENTS 1102676 3/1961 Fed. Rep. of Germany ..... 285/146

*Primary Examiner*—Thomas F. Callaghan
*Assistant Examiner*—Anthony Knight

[57] ABSTRACT

An improved wellhead slip and seal assembly including a slip assembly with slips supported within a slip bowl and a seal assembly positioned above the slip assembly and interconnected thereto for supporting the slip assembly, the seal assembly including two segments connected to form the seal ring and each of the segments includes arcuate elements embedded in a resilient material which forms an inner seal in an inner groove, the inner seal having an inner diameter sufficient smaller than the outer diameter of the pipe to which it is to seal and an outer seal of the resilient material in an outer groove, the outer seal having an outer diameter sufficiently larger than the inner diameter of the wellhead housing into which it is inserted so that both seals are brought into direct sealing engagement with their respective pipe and housing sealing surfaces and the loading on the slip bowl is not a seal compressing load through the connection between the seal assembly and the slip assembly. The segments of the slip bowl include segments interconnected by toe nails and the seal ring includes pin and recess connection for connecting the two segments together. Sufficient resilient material is used so that joining of the segments seals along the axial edges thereof.

9 Claims, 3 Drawing Sheets

12
32
60
30
40
46
34
44
38
26
42
24
36
52
16
16
28
20
20
58
18
56
57
59
22
10
54
50
48
14
55

FIG.2
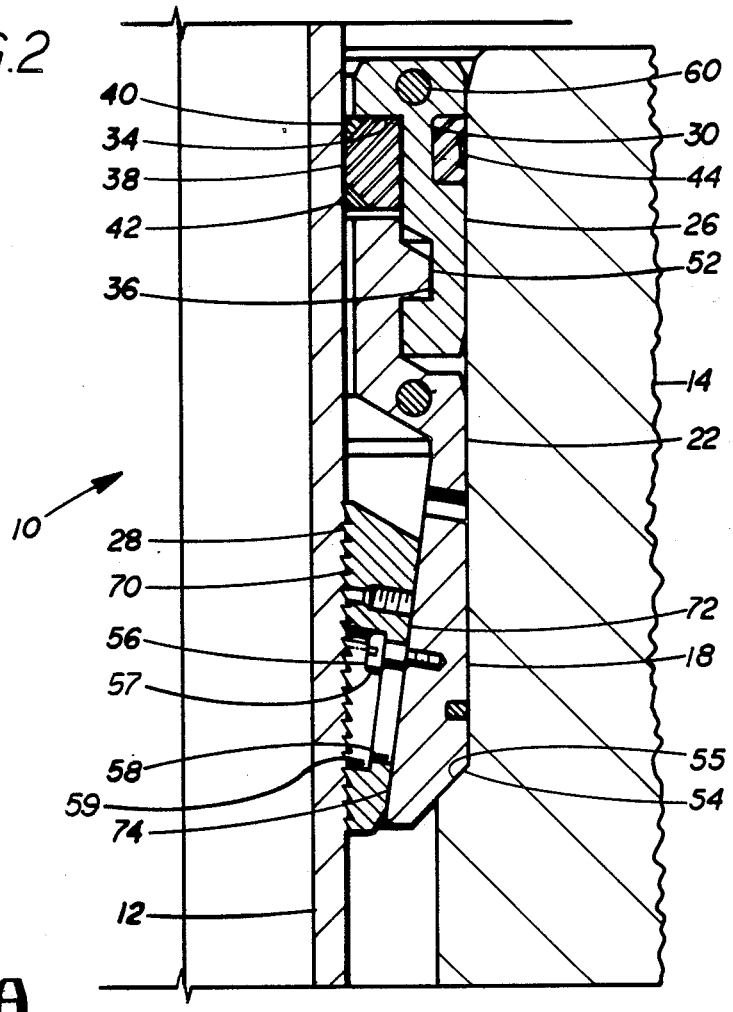
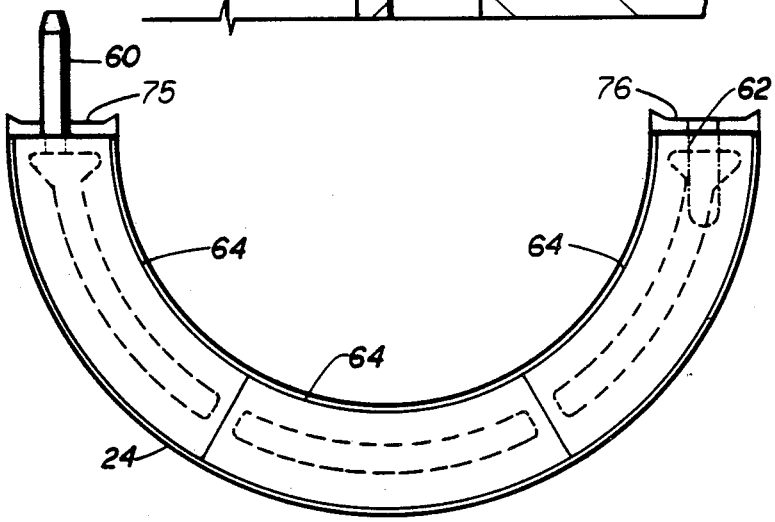
FIG.3

WELLHEAD SLIP AND SEAL ASSEMBLY

BACKGROUND

The assembly of the present invention is used to support and seal a pipe or other string within a wellhead.

An example of a prior structure is illustrated in U. S. Pat. No. 2,920,909 to H. Allen. In this patent the pipe is supported by slips within a slip bowl which is supported on the tapered interior of the wellhead housing and upper slips are supported above a conical shaped seal ring so that the load of the supported pipe causes the seal ring to expand inward and outwardly into sealing engagement between the exterior of the pipe and the interior of the wellhead housing.

U.S. Pat. Nos. 3,311,168 and 4,390,186 disclose similar structures in which a landing ring supports inner and outer seal rings and the slip bowl engages the seal rings to the pipe load of the slip bowl is transmitted at least in part through the seal rings.

U.S. Pat. No. 4,494,778 to C. W. Johnson discloses another similar structure in which the slip bowl is connected to a seal assembly ring above the slip bowl by cap screws so that the seal assembly is moved into the interior of the wellhead housing as the slip bowl is lowered therein. The seal assembly includes spreaders which are forced inwardly as the seal assembly is moved within the housing and this movement of the spreaders compresses the seal ring so that it is moved radially into sealing engagement between the interior of the wellhead housing and the exterior of the pipe string.

U.S. Pat. Nos. 2,824,757 and 3,287,035 are other structures for supporting and sealing a pipe string within a wellhead housing in which the slip bowl is connected to the seal loading so that the seal is set responsive to loading of the slip bowl by its support through its slips of the pipe string.

SUMMARY

The present invention relates to an improved wellhead slip and seal assembly including a slip assembly with slips supported within a slip bowl which includes segments interconnected by toe nails and a seal assembly positioned above the slip assembly and interengaged therewith, the seal assembly including two segments connected to form the seal ring and each of the segments includes arcuate elements embedded in a resilient material which forms an inner seal in an inner groove, the inner seal having an inner diameter sufficient smaller than the outer diameter of the pipe on which it is to seal and an outer seal of the resilient material in an outer groove, the outer seal having an outer diameter sufficiently larger than the inner diameter of the wellhead housing into which it is inserted so that both seal are brought into direct sealing engagement with their respective pipe and housing sealing surfaces and the loading on the slip bowl is not a seal compressing load through the connection between the seal assembly and the slip assembly.

An object of the present invention is to provide an improved slip and seal assembly for supporting and sealing against a pipe within a wellhead housing in which the seal is not dependent upon the support load of the slip assembly.

Another object is to provide an improved slip and seal assembly in which test pressure is not added to the slip load.

A further object is to provide an improved slip and seal assembly in which test pressure does not add to the pipe collapse forces generated by the slips.

Still another object is to provide an improved slip and seal assembly in which changes in temperature to which the seal is exposed does not change the position of the supported pipe.

BRIEF DESCRIPTION OF THE DRAWINGS

These and other objects and advantages are hereinafter set forth and explained with reference to the drawings wherein:

FIG. 2 is a partial sectional view of the improved assembly of the present invention illustrating the initial gripping engagement of the slips on the exterior of the string extending therethrough.

FIG. 3 is a plan view of one of the seal segments to illustrate the projecting connecting pin and the integral resilient material of the segment.

DESCRIPTION OF THE PREFERRED EMBODIMENT

Figure 1:
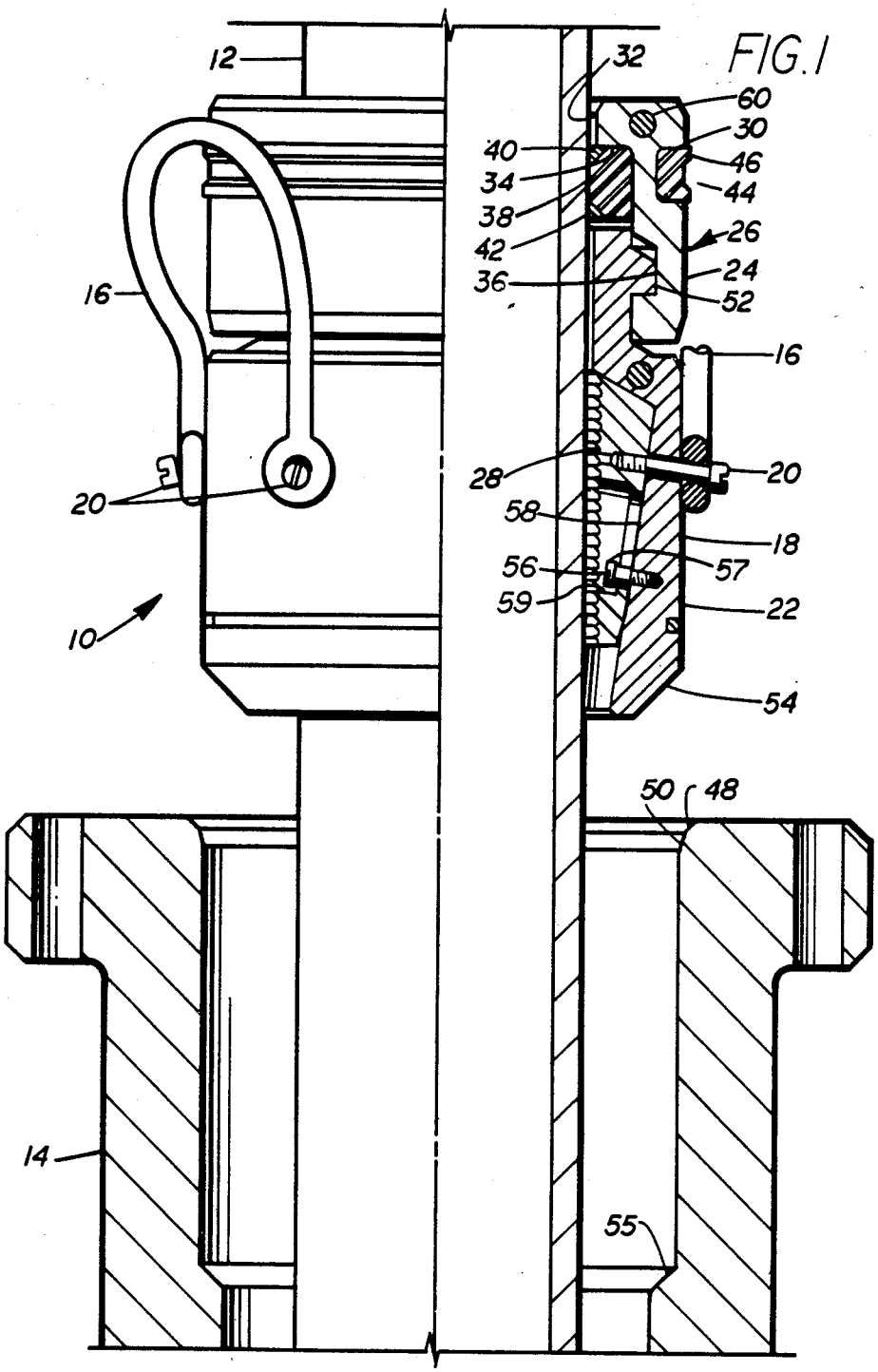
FIG. 1 is an elevation view, partly in section, showing the improved wellhead slip and seal assembly of the present invention being lowered into a wellhead housing into which it is to seat and support a string.

Improved wellhead slip and seal assembly 10 is shown in FIG. 1 in surrounding relationship to string 12 and being lowered into wellhead housing 14. Bails 16 are secured to the sides of bowl 18 by screws 20 and are used to control the movement of assembly 10 prior to lowering assembly 10 into its position within housing 14 as hereinafter described.

Assembly 10 includes a pair of bowl segments 22 which are connected to form bowl 18 as hereinafter described, a pair of sealing segments 24 which form seal ring 26 and slips 28. Sealing segments 24 are embedded in a suitable resilient material, such as an elastomer, which joins three of segments 24 as shown in FIG. 3 and hereinafter described. Seal ring 26 includes outer groove 30, inwardly directed flange 32 forming downwardly facing shoulder 34 and lower inner annular groove 36. Inner seal 38 which is formed by the resilient material surrounding segments 24, is positioned under shoulder 34 and above the upper end of bowl 18 as shown and has an inner diameter which is smaller than the diameter of the string 12. Inner seal 38 also includes upper and lower inner seal support rings 40 and 42 which are embedded therein to prevent the extrusion of seal 38 from its position between the exterior of string 12 and the interior of seal ring 26. Outer seal 44 which also is formed by the resilient material surrounding segments 24, is positioned within outer groove 30 and includes lips 46 which as shown in FIG. 1 have a greater diameter than the inner diameter of housing 14. Housing 14 includes upper inner tapered surfaces 48 and 50 which ensure smooth entry of seal 44 within housing bore 55A. The insertion of assembly 10 into housing bore 55A causes the outer diameter of the seal ring 26 to be constricted to the smaller diameter of the housing bore 55A. The diametrical constriction of seal ring 26 in conjunction with the fixed length of arcuate elements 64 of sealing segments causes the end of resilient seal elements 38 and 44 to be pressed together, causing them to seal together forming inner and outer circumferential seals.

Bowl 18 includes outer projection 52 which is positioned within inner groove 36. During initial installation of assembly 10 slips 28 are held in position within bowl 18 by screws 20. The lower surface 54 of bowl 18 is tapered downwardly and inwardly to assist in the entry of assembly 10 within housing 14 and to land on internal housing seat 55 as shown in FIG. 2. Bails 16 are removed and slips 28 are released for normal operation by the removal of screws 20. Thereafter, assembly 10 slides downwardly on string 12 into housing 14 toward the position illustrated in FIGURE 2. Screws 56 thread into the interior of bowl 18, having their shanks within slots 58 on the interior of slips 28 and their heads 57 within enlarged slots 59 to allow relative freedom of vertical movement between slips 28 and bowl 18 in normal operations and to retain slips 28 within bowl 18. The load of the string of pipe 12 will pull seal ring 26 into housing bore 55A and thereby energize outer seal 44 into tight sealing engagement therewith.

It should be noted that there is no substantial relative vertical movement between bowl 18 and seal ring 26. The effectiveness of seals 38 and 44 are thus not dependent upon an axial compression between upper and lower members of assembly 10 to provide the needed inner and outer sealing but rather provide the radial compression of the seals 38 and 44 to ensure their sealing against the exterior of string 12 and housing bore 55A. The support rings 40 and 42 on inner seal 38 protect it against the relatively large gaps which may be encountered between the exterior of string 12 and the interior of seal ring 26 due to the large casing string outer diameter variations which result from manufacturing tolerances.

Figure 4:
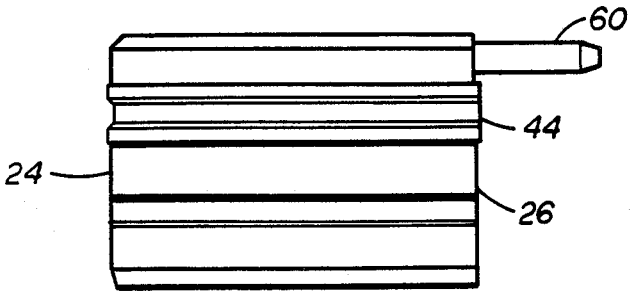
FIG. 4 is an elevation view of the seal segment.

Sealing segment 24 is shown in FIGS. 3 and 4 and includes pin 60 projecting from one side and recess 62 on the opposite side. Each segment 24 includes a plurality of arcuate elements 64 which are combined together into segment 24 by encapsulating them in molded rubber or elastomer with the rubber extending along the two ends 75 and 76, and in surrounding relationship to provide sealing between the ends of segments 24 and a coating surrounding the segments 24. The elastomer functions also as inner seal 38 and outer seal 44. Once two segments 24 are in position with their pins 60 in the opposite segment recess 62, they are held in position by entry into housing 14.

Figure 5:
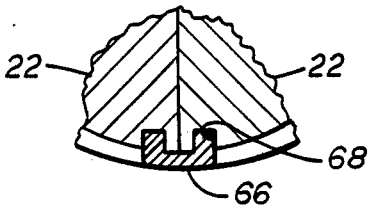
FIG. 5 is a partial sectional view illustrating the toe nailing of the bowl segments together.
Figure 6:
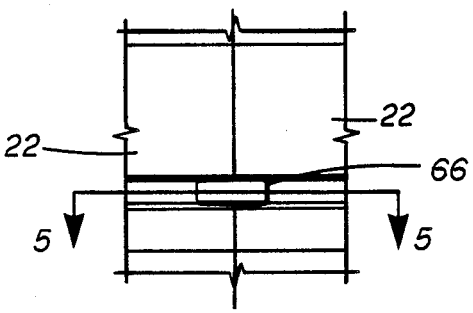
FIG. 6 is a partial elevational view of the toe nailing of the bowl segments.

Bowl segments 22 are secured in their assembled position by U-shaped toe nails 66 which are driven into openings 68 in adjacent portions of segments 22 as best shown in FIGS. 5 and 6.

Slips 28 are positioned within bowl 18 with their engaging teeth 70 facing inwardly and upwardly for tight gripping and supporting engagement with string 12. Outer surface 72 of slips 28 is tapered downwardly and inwardly and mates with internal tapered surface 74 on bowl 18.

With the positioning of the seal rings 38 and 44 and the slips 28 the application of test pressure to test the seals does not add to the slip loading, does not provide any pressure loading which would increase the crushing of the pipe in the area engaged by the slips and the support of the casing is not dependent on the seals, in fact the seals could be removed without creating any problems in the support of the pipe by the slips.

What is claimed is:

1. A wellhead slip and seal assembly for supporting and sealing a string within a housing comprising a seal ring having an inner flange with a downwardly facing shoulder and an outer groove, a first resilient sealing ring positioned within said outer groove and having an outer diameter larger than the housing in which it is to be positioned, a second resilient sealing ring positioned adjacent said shoulder and having an inner diameter smaller than the outer diameter of the string to be received therein, a slip bowl having a downward and inward tapering surface, a plurality of slips having inwardly facing teeth and outer tapered surfaces mating with the slip bowl tapered surface, and means on said seal ring and said slip bowl providing an interengagement for supporting said slipbbowl from said seal ring during the lowering of said assembly into the housing, the upper end of said slip bowl being positioned below said second sealing ring.

2. A wellhead slip and seal assembly according to claim 1 wherein said supporting interengagement includes a groove on the interior of said seal ring, and a projection of the exterior of said slip bowl positioned within said seal ring inner groove.

3. A wellhead slip and seal assembly according to claim 1 wherein said second sealing ring includes means for preventing extrusion of said seal ring between said shoulder and the string against which it is to be sealed.

4. A wellhead slip and seal assembly according to claim 1 including means for handling said assembly during transportation and installation.

5. A wellhead slip and seal assembly according to claim 4 wherein said handling means includes bails secured to said assembly by fasteners extending through said bowl and engaging said slips to maintain said slips in retracted position prior to installation.

6. A wellhead slip and seal assembly according to claim 1 wherein said bowl includes a pair of bowl segments, means providing interengagement between said segments and means securing said segments together.

7. A wellhead slip and seal assembly according to claim 6 wherein said segment securing means includes U-shaped toe nails engaging within openings in said bowl segments and spanning the engaging faces of said segments.

8. A wellhead slip and seal assembly according to claim 1 wherein the seal ring includes a pair of sealing segments, and each of said sealing segments includes a plurality of arcuate elements, and a resilient coating covering said arcuate elements binding said elements together to form one of said sealing segments.

9. A wellhead slip and seal assembly according to claim 8 wherein said resilient coating and said first and second sealing rings being formed during the embedding of said arcuate elements therein.

* * * * *